US008723014B2

(12) United States Patent
Susami

(10) Patent No.: US 8,723,014 B2
(45) Date of Patent: May 13, 2014

(54) MUSICAL TONE CONTROL DEVICE, SYSTEM AND PROCESS

(71) Applicant: Roland Corporation, Shizuoka-ken (JP)

(72) Inventor: Ryo Susami, Hamamatsu (JP)

(73) Assignee: Roland Corporation, Hamamatsu (JP)

( * ) Notice: Subject to any disclaimer, the term of this patent is extended or adjusted under 35 U.S.C. 154(b) by 78 days.

(21) Appl. No.: 13/651,295

(22) Filed: Oct. 12, 2012

(65) Prior Publication Data

US 2013/0145923 A1 Jun. 13, 2013

(30) Foreign Application Priority Data

Dec. 13, 2011 (JP) ..... 2011-272079

(51) Int. Cl.
*G10H 7/00* (2006.01)

(52) U.S. Cl.
USPC ..... 84/723; 84/746; 84/402; 84/422.3

(58) Field of Classification Search
USPC ..... 84/723, 746, 402, 422.3
See application file for complete search history.

(56) References Cited

U.S. PATENT DOCUMENTS

| | | | | |
|---|---|---|---|---|
| 4,984,498 | A * | 1/1991 | Fishman | 84/730 |
| 5,748,566 | A * | 5/1998 | Goodson | 367/158 |
| 6,576,829 | B1 * | 6/2003 | Hart | 84/737 |
| 6,815,604 | B2 * | 11/2004 | Toda | 84/746 |
| 7,294,778 | B2 * | 11/2007 | Susami | 84/723 |
| 7,323,632 | B2 * | 1/2008 | Wachter | 84/730 |
| 7,459,626 | B2 * | 12/2008 | Yoshino et al. | 84/723 |
| 7,468,483 | B2 * | 12/2008 | Yoshino | 84/723 |
| 7,473,834 | B2 * | 1/2009 | Yoshino | 84/402 |
| 7,560,638 | B2 * | 7/2009 | Susami | 84/723 |
| 7,655,857 | B2 * | 2/2010 | Yoshino et al. | 84/723 |
| 7,820,903 | B2 | 10/2010 | Susami | |
| 7,943,841 | B2 * | 5/2011 | Toda | 84/422.3 |
| 8,410,348 | B1 * | 4/2013 | Hsieh | 84/743 |
| 2002/0014810 | A1 * | 2/2002 | Maruyama | 310/323.06 |
| 2004/0016339 | A1 * | 1/2004 | Yoshino et al. | 84/723 |
| 2005/0039593 | A1 * | 2/2005 | Wachter | 84/730 |
| 2005/0145101 | A1 * | 7/2005 | Yoshino | 84/723 |
| 2005/0145102 | A1 * | 7/2005 | Susami | 84/735 |
| 2005/0150349 | A1 * | 7/2005 | Susami | 84/299 |
| 2006/0066181 | A1 * | 3/2006 | Bromfield et al. | 310/363 |
| 2006/0156910 | A1 * | 7/2006 | Yoshino | 84/723 |
| 2012/0048099 | A1 * | 3/2012 | Wissmuller | 84/723 |
| 2012/0118130 | A1 * | 5/2012 | Field | 84/730 |
| 2013/0047826 | A1 * | 2/2013 | Wissmuller | 84/723 |
| 2013/0125735 | A1 * | 5/2013 | Mori | 84/723 |

FOREIGN PATENT DOCUMENTS

| | | | |
|---|---|---|---|
| JP | 09-097075 | A | 4/1997 |
| JP | 2005-195892 | A | 7/2005 |
| JP | 2006-133697 | A | 5/2006 |
| JP | 2006-201334 | A | 8/2006 |
| JP | 2009-080444 | A | 4/2009 |

* cited by examiner

*Primary Examiner* — David S. Warren
(74) *Attorney, Agent, or Firm* — Foley & Lardner LLP

(57) ABSTRACT

A musical tone control device capable of generating a hi-hat sound intended by the performer operates such that, when striking surface position information corresponds to a first position, instructions are provided to stop generating a musical tone with a first timbre (or that satisfies another predetermined condition), when the striking surface position has reached a predetermined second position higher than the first position after instructions are provided to generate the musical tone. Since, the performer's intention is reflected in the transition state of the striking surface position, a musical tone according to the performer's intention can be generated.

16 Claims, 5 Drawing Sheets

MUSICAL TONE CONTROL DEVICE, SYSTEM AND PROCESS

CROSS-REFERENCE TO RELATED PATENT APPLICATIONS

Japan Priority Application No. 2011-272079, filed on Dec. 13, 2011, including the specification, drawings, claims and abstract, is incorporated herein by reference in its entirety.

FIELD OF THE INVENTION

Embodiments of the present invention relate, generally, to musical tone control devices. Particular embodiments of the invention relate to a musical tone control device that is capable of properly stopping slightly-open sounds in an electronic hi-hat.

BACKGROUND

Attempts have been made to configure an electronic hi-hat cymbal to simulate an acoustic hi-hat cymbal. Musical tones are generated by an electronic hi-hat cymbal, in response to a striking of an upper pad. The electronic hi-hat generates and stops musical tones (hi-hat sounds), based on the position of the hi-hat as controlled by the operation of the foot pedal. For example, the control to stop hi-hat sounds having an open group timbre is performed by stopping the generation of the sounds at a tone generation control position. The hi-hat sounds with the open group timbre include open sound, half open sound and slightly-open sound, corresponding to a hi-hat cymbal that is open, half open and slightly open, respectively. The tone generation control position is set in advance, at a position where the hi-hat is partially closed by a specific amount. In the case of an acoustic hi-hat cymbal in a partially closed state, striking sounds are gradually extinguished by interference between the separated upper and lower cymbals. The aforementioned tone generation stop control of the electronic hi-hat cymbal simulates the behavior of such an acoustic hi-hat cymbal.

In the electronic percussion musical instrument described in Japanese Laid-open Patent Application 2006-133697, when the hi-hat moves to the closed position, the percussive sound being generated is silenced, and a pedal close sound is generated according to the striking intensity of the immediately preceding strike. According to the electronic percussion musical instrument described in Japanese Laid-open Patent Application 2009-80444, when the hi-hat is struck at an open group position and generates a sound, silencing of the hi-hat sound is controlled based on the striking intensity at that moment and changes in the position of the hi-hat taking place thereafter. An open group position may be the open position, the half open position and the slightly-open position.

However, when the stop control position is set at the slightly-open position, slightly-open sound that is generated by a strike while the hi-hat is at the slightly-open position, might unnaturally be stopped by slight movements of the foot pedal. For this reason, the slightly-open sound is adjusted to be stopped, only when the foot pedal is stepped on relatively strongly.

One common hi-hat performance techniques is to generate a slightly-open sound by striking the pad at the slightly-open position, releasing the depression of the foot pedal to slightly open the hi-hat, and thereafter stepping on the foot pedal again to move the hi-hat to the closed position. However, with a conventional electronic hi-hat as described above, when the aforementioned performance technique is carried out, generation of the slightly-open sound that is supposed to stop, instead, may continue due to insufficient depression of the foot pedal, even though the hi-hat appears to be closed. Accordingly, the resulting performance may be different from that which the performer intends.

SUMMARY OF THE DISCLOSURE

Embodiments of the present invention relate to a musical tone control device that is capable of generating hi-hat sounds that are intended by the performer.

In a musical tone control device according to an embodiment of the present invention, when a strike on the striking surface is detected, if position information obtained by a position information acquisition device indicates a striking surface position within a predetermined range that includes at least a first position, a tone generation device instructs a sound source to generate a musical tone with a first timbre. When the tone generation device instructs the sound source to generate the musical tone with the first timbre, a transition state information acquisition device acquires information for the transition state of the striking surface position thereafter, based on position information acquired by the position information acquisition device. If the position information obtained by the position information acquisition device indicates that the striking surface position is at the first position, a sound source stop instruction device instructs the sound source to stop the musical tone with the first timbre that satisfies a predetermined condition, based on information acquired by the transition state information acquisition device. More specifically, the musical tone that satisfies the predetermined condition is a musical tone with the first timbre that is being generated from the sound source, when the striking surface position has reached a predetermined second position higher than the first position after the tone generation instruction device instructed the sound source to generate the musical tone. The performer's performance intention is reflected in the transition state of the striking surface position, since the tone generation instruction device instructs the sound source to generate a musical tone. Therefore, by stopping the musical tone with the first timbre based on information concerning the transition state of the striking surface position (information that is obtained by the transition state information acquisition device), a musical tone (hi-hat sound) according to the performer's intention can be generated.

According to further embodiments of a musical tone control device as described above, the sound source stop instruction device instructs the sound source to stop a first musical tone that satisfies a predetermined condition among musical tones with the first timbre being generated from the sound source, based on information obtained by the transition state information acquisition device (first time information obtained by the first time information acquisition device, and second time information obtained by the second time information acquisition device). More specifically, the first musical tone that satisfies the predetermined condition is a musical tone with the first timbre being generated from the sound source, which corresponds to the first time information given earlier than the second time information. In other words, the sound source stop instruction device instructs the sound source to stop a musical tone that would be generated with the first timbre due to the striking surface position having reached a predetermined second position higher than the first position after the tone generation instruction device instructed the sound source to generate the musical tone. Accordingly, the musical tone with the first timbre to be stopped, based on the performer's performance intention, can be determined based on the time information. The "time information" may include the time or counter values that are periodically updated.

According to further embodiments of a musical tone control device as described above, the sound source stop instruction device instructs the sound source to stop a first musical tone that satisfies a predetermined condition among musical tones with the first timbre being generated from the sound source, based on information obtained by the transition state information acquisition device (first information stored in the information storage device, and second information updated by the information update device). More specifically, the first musical tone that satisfies the predetermined condition is a musical tone with the first timbre being generated from the sound source, wherein the second information for the musical tone with the first timbre is stored in the information storage device. In other words, the sound source stop instruction device instructs the sound source to stop a musical tone that would be generated with the first timbre due to the striking surface position having reached a predetermined second position higher than the first position after the tone generation instruction device instructed the sound source to generate the musical tone. Accordingly, the musical tone with the first timbre to be stopped, based on the performer's performance intention, can be determined based on the content stored in the information storage device.

According to further embodiments of a musical tone control device as described above, the sound source stop instruction device instructs the sound source to stop a first musical tone that satisfies a predetermined condition among musical tones with the first timbre being generated by the sound source, based on information obtained by the transition state information acquisition device (displacement amount information obtained by the displacement amount information acquisition device). More specifically, the first musical tone that satisfies the predetermined condition is a musical tone with the first timbre that is being generated from the sound source, of which the displacement amount corresponding to the displacement amount information obtained by the displacement amount information acquisition device exceeds a predetermined threshold value. In other words, the sound source stop instruction device instructs the sound source to stop a musical tone that would be generated with the first timbre due to the striking surface position having reached a predetermined second position higher than the first position after the tone generation instruction device instructed the sound source to generate the musical tone. Accordingly, the musical tone with the first timbre to be stopped by instructing the sound source based on the performer's performance intention can be determined based on the displacement amount that the striking surface position has displaced while the tone is being generated from the sound source.

BRIEF DESCRIPTION OF THE DRAWINGS

FIG. 1(*b*) is an enlarged (relative to FIG. 1(*a*)) side, cross-sectional view of the upper portion of the electronic hi-hat device of FIG. 1(*a*).

DETAILED DESCRIPTION

Figure 1:
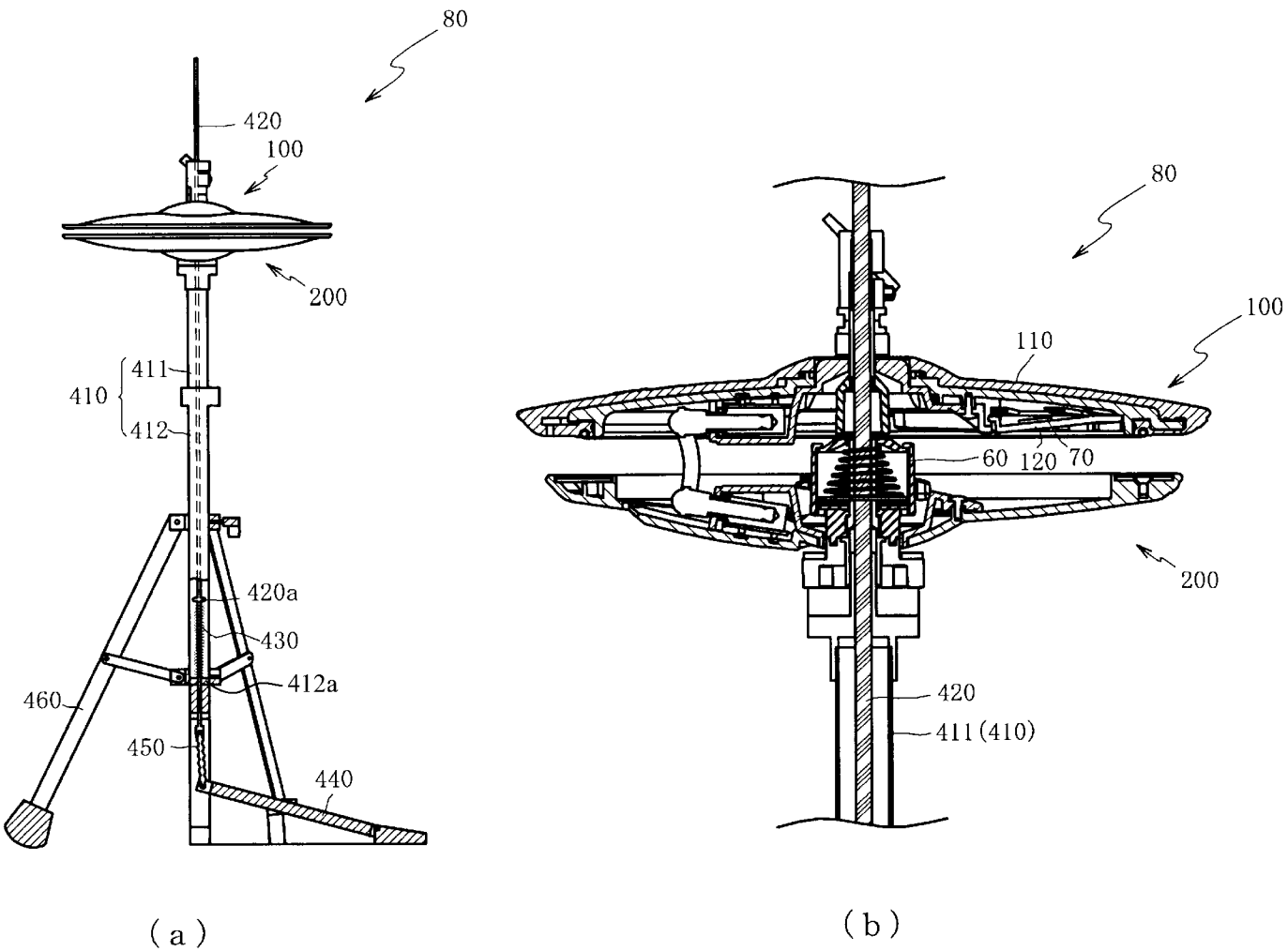
FIG. 1(*a*) is a side view (partially cross-sectional) of an entire electronic hi-hat device.

Embodiments of the invention are described below with reference to the accompanying drawings. An example of an electronic hi-hat device 80 is shown in FIG. 1 (*a*). FIG. 1(*a*) shows a side view (partially cross-sectional) of the entire electronic hi-hat device 80, where an upper cymbal 100, a lower cymbal 200 and a portion between the upper cymbal 100 and the lower cymbal 200 are shown, but not shown in cross-section. However, a cross-sectional view of the upper cymbal 100, lower cymbal 200 and the portion between the upper and lower cymbals is shown in FIG. 1 (*b*).

As is shown in FIG. 1 (*a*), the electronic hi-hat 80 includes the upper cymbal 100, the lower cymbal 200, an extension rod 420, a hollow shaft member 410, a spring 430, a foot pedal 440, a joint 450, and a leg section 460. The upper cymbal 100 is linked to the extension rod 420 for swinging motion. The lower cymbal 200 is linked to the hollow shaft member 410 for swinging motion. The spring 430 is fitted inside the lower end of the hollow shaft member 410. The foot pedal 440 is configured to be treaded. The joint 450 connects the extension rod 420 and the foot pedal 440. The leg section 460 is linked to the hollow shaft member 410, for supporting the electronic hi-hat 80 in a standing orientation.

The extension rod 420 is linked, on its lower portion, to the foot pedal 440 through the joint 450. By this configuration, the extension rod 420 moves up and down in conformance with a treading operation of the foot pedal 440. The upper cymbal 100 is linked by a link fitting to the upper portion of the extension rod 420 for swinging motion. Accordingly, the upper cymbal 100 moves up and down, in association with the up and down movement of the extension rod 420, according to a treading operation of the foot pedal 440. In other words, the position of a striking surface of the upper cymbal 100 changes according to the amount of treading operation of the foot pedal 440.

The lower portion of the extension rod 420 passes through the upper hollow shaft 411 and the lower hollow shaft 412. Further, the lower portion of the extension rod 420 also passes through the spring 430 inside the lower hollow shaft 412. The spring 430 is held between the bottom of a knurl section 420*a* on the extension rod 420 and the top of a knurl section 412*a* of the lower hollow shaft 412, such that the extension rod 420 is always subjected to a force biasing the rod 420 upward. As a result, when the treading operation of the foot pedal 440 is not being carried out, the upper cymbal 100 and the lower cymbal 200 are separated at a specified interval.

FIG. 1(*b*) shows the upper cymbal 100 and the lower cymbal 200 in an open position or a separated state. As described above, when the treading operation of the foot pedal 440 is not being carried out, the upper cymbal 100 and the lower cymbal 200 are placed in the open position as shown in FIG. 1 (*b*). As the foot pedal 440 is stepped on, and the amount of treading becomes greater, the striking surface position of the upper cymbal 100 lowers, and the upper cymbal 100 and the lower cymbal 200 will eventually be placed in a closed position in which the upper cymbal 100 and the lower cymbal 200 are in a state of close contact.

The top surface of the upper cymbal 100 has a striking surface 110. In an example embodiment, the striking surface is formed from a rubber material. A vibration sensor 70 for detecting vibrations is disposed on a vibration sensor attaching frame 120 on the bottom side of the upper cymbal 100, below the striking surface 110. The vibration sensor 70 is a sensor that detects the vibration level of vibrations of the upper cymbal 100 caused by striking the upper cymbal 100 or by contact between the upper cymbal 100 and the lower cymbal 200. The vibration sensor 70 may be, for example, but not limited to, a piezoelectric sensor. When the vibration sensor 70 detects a vibration, striking information according to the detected vibration level is transmitted to the lower cymbal 200, through a wiring. The striking information is outputted to a musical tone control device 1 (see FIG. 2), through an output terminal (not shown in the drawing) provided on the lower cymbal 200.

A displacement sensor 60 is disposed between the upper cymbal 100 and the lower cymbal 200. The displacement sensor 60 may be any suitable type of displacement sensor such as, but not limited to a displacement sensor as described in Japanese laid-open patent application 2005-195892. In one example, the displacement sensor 60 is configured with a sensor sheet, a coil spring, and a cover section. The sensor sheet is circularly formed and housed in the bottom of the inside of a hollow cylinder having an open top. The coil spring is arranged on the sensor sheet, and is formed in a configuration that widens from the top downward. The cover section is in contact with the top of the coil spring.

When the foot pedal 440 is stepped on, the gap between the upper cymbal 100 and the lower cymbal 200 closes by an amount in conformance with the amount that the foot pedal has been depressed. As the upper cymbal 100 descends, the cover section is pressed downward, and the coil spring is pressed against the sensor sheet and is compressed and changes shape (deforms) in the vertical direction due to the compression force. The sensor sheet detects the deformation generated in the coil spring caused by the compression in the vertical direction, by providing an electrical resistance value (hereafter referred to as a "displacement sensor value"). More specifically, the amount of depression of the foot pedal 440 being treaded, in other words, the displacement sensor value according to the position of the upper cymbal 100 (hereafter, referred to as the "striking surface position") is detected by the sensor sheet. The displacement sensor value detected by the sensor sheet is outputted, through an output terminal (not shown in the drawing), to the musical tone control device 1 (see FIG. 2) as position information indicative of the striking surface position.

Therefore, the electronic hi-hat 80 in accordance with an embodiment of the present invention includes the displacement sensor 60 that is capable of detecting the position (the striking surface position) on the upper cymbal 100. In addition, the electronic hi-hat 80 includes the vibration sensor 70 that detects the vibration of the upper cymbal 100 caused by a strike on the upper cymbal 100, or by the upper cymbal 100 contacting the lower cymbal 200 as the foot pedal is stepped on. Vibration information according to the detected vibration level is outputted from the vibration sensor 70 to the musical tone control device 1 (see FIG. 2). In addition, the electrical resistance value according to the striking surface position detected by the displacement sensor 60 is outputted to the musical tone control device 1 (see FIG. 2).

Figure 2:
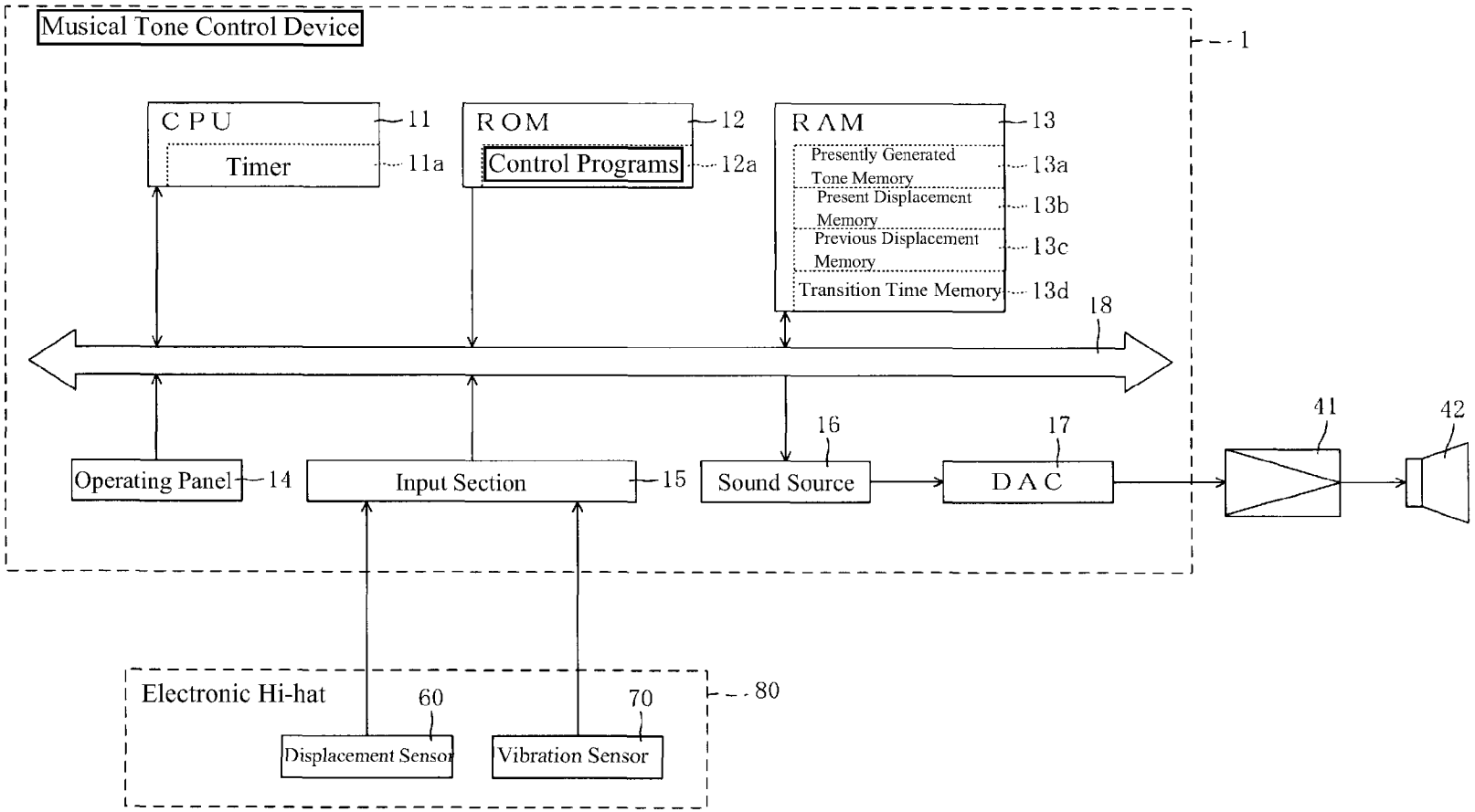
FIG. 2 is a block diagram of an electrical configuration of a musical tone control device according to an embodiment of the present invention.

An example of an electrical configuration of the musical tone control device 1 in accordance with an embodiment of the invention, is described with reference to FIG. 2. When the vibration information from the electronic hi-hat 80 is inputted in the musical tone control device 1, the musical tone control device 1 generates a musical tone having a timbre that corresponds to the displacement sensor value at that moment. In other words, when the upper cymbal 100 in the electronic hi-hat 80 vibrates, the musical tone control device 1 generates a musical tone having a timbre that corresponds to the striking surface position of the upper cymbal 100, as it vibrates. The present embodiment is described, based on the assumption that the musical tone control device 1 generates only musical tones based on performance operations (striking and pedal operations) of the electronic hi-hat 80.

As described in further detail, below, the musical tone control device 1 is configured to perform a tone silencing control on slightly-open sound, in accordance with the transition state of the striking surface position after generation of the slightly-open sound. Accordingly, musical tones (hi-hat sounds) of the electronic hi-hat 80 that sufficiently reflect the performance intention of the user are generated.

The musical tone control device 1 includes a CPU 11, a ROM 12, a RAM 13, an operating panel 14, an input section 15, a sound source 16, and a digital/analog converter (DAC) 17. The components 11-16 are connected together, via a bus line 18. The sound source 16 is also connected to the DAC 17.

The CPU 11 is a central processing unit that controls each of the components of the musical tone control device 1, according to fixed values and programs stored in the ROM 12, data stored in the RAM 13, and the like. A timer 11*a*, which times the time periods described herein by measuring clock signals, may be connected to or built into the CPU 11.

The ROM 12 is a non-rewritable, nonvolatile memory. The ROM 12 stores control programs 12*a* that are executed by the CPU 11 and fixed data (not shown in the drawing) that are referred to by the CPU 11 at the time of the execution of the control programs 12*a*. Processing executed by the control programs 12*a* is shown in the flowcharts in FIG. 4 and FIG. 5.

The RAM 13 is a rewritable volatile memory. The RAM 13 provides a temporary storage area that temporarily stores various types of data used at the time of the execution of the control programs 12*a* by the CPU 11. The temporary storage area of the RAM 13 is provided with a presently generated tone memory 13*a*, a present displacement memory 13*b*, a previous displacement memory 13*c*, and a transition time memory 13*d*. These memories 13*a*-13*d* are initialized when the musical tone control device 1 is powered on.

The presently generated tone memory 13*a* is a memory region that stores, in association with each other, a timbre of a musical tone to be generated by the sound source 16, a voice of the sound source 16 assigned to the musical tone, and a generation time of the musical tone. More specifically, the presently generated tone memory 13*a* is configured with a timbre storage region, a voice storage region and a tone generation time storage region. The storage regions (the timbre storage region, the voice storage region and the tone generation time storage region) are provided for each musical tone to be generated from the sound source 16.

When the CPU 11 determines, based on vibration information, that the upper cymbal 100 has been struck, the CPU 11 stores, in the timbre storage region, timbre information indicative of a timbre for a musical tone to be generated for the strike, according to a displacement sensor value at that moment. Then, the CPU 11 stores, in the voice storage region, voice information indicative of a voice of the sound source 16 assigned to the musical tone. Further, the CPU 11 stores, in the tone generation time storage region, the current time as a tone generation time. On the other hand, when a tone generation stop instruction is outputted to the sound source 14, the CPU 11 clears information (timbre information, voice information, and tone generation time) for a musical tone that is subject to the stop instruction, among contents stored in the presently generating tone memory 13*a*.

The present displacement memory 13*b* is a memory region that stores a displacement sensor value presently inputted from the displacement sensor 60 of the electronic hi-hat 80. On the other hand, the previous displacement memory 13*c* is a memory region that stores a displacement sensor value that was previously inputted from the displacement sensor 60. Specifically, each time a displacement sensor processing is executed (see FIG. 5), the value stored in the present displacement memory 13*b* is stored in (moved to) the previous displacement memory 13*c*, and then the acquired displacement sensor value is stored in the present displacement memory 13*b*.

Figure 3:
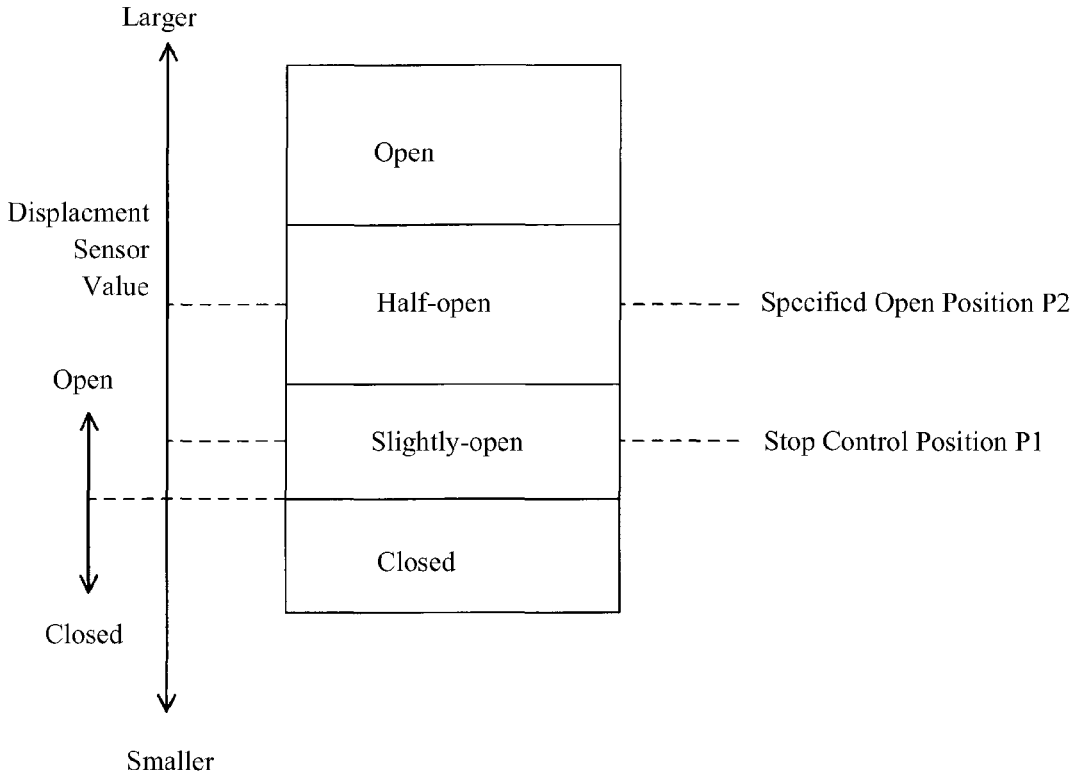
FIG. 3 is a diagram representing various positions specified by position sensor values, according to an embodiment of the present invention.

The transition time memory 13*d* is a memory region that stores the time (transition time) at which the striking surface position of the upper cymbal 100 moving in a direction to a more opened position, reaches a specified open position P2 (see FIG. 3).

The operating panel 14 is a panel provided with one or more operators and display devices, and is used as a user interface. Various parameters such as volume and the like are set by using the operators. Parameter values set by the operators are displayed on the display devices.

The input section 15 is an interface for connecting the musical tone control device 1 with the displacement sensor 60 and the vibration sensor 70 of the electronic hi-hat 80. Analog signals (vibration information, displacement sensor values) outputted from the respective sensors 60 and 70 are inputted via the input section 15 to the musical tone control device 1. An analog-to-digital converter is built into the input section 15. An analog signal inputted from each of the sensors 60 and 70 is converted by the analog-to-digital converter to a digital value each predetermined time period, and outputted to the CPU 11. When the vibration information inputted from the vibration sensor 70 indicates a vibration level that exceeds a predetermined threshold value, the CPU 11 determines that the striking surface of the upper cymbal 100 of the electronic hi-hat 80 is struck. The CPU 11 outputs, to the sound source 16, a tone generation instruction to generate a musical tone having a timbre according to the displacement sensor value at that moment.

Upon receiving the tone generation instruction from the CPU 11, the sound source 16 generates a musical tone with a timbre according to the tone generation instruction. Also, upon receiving a tone stop instruction from the CPU 11, the sound source 16 stops generation of a tone designated by the tone stop instruction. The sound source 16 is configured such that multiple musical tones (voices) can be generated. Upon receiving the tone generation instruction from the CPU 11, the sound source 16 generates a digital musical tone with a timbre and a volume that correspond to the tone generation instruction, through a voice allocated by the tone generation instruction. It is noted that the voice may be composed of a single tone generation channel or a plurality of tone generation channels.

The sound source 16 has a built-in waveform ROM (not shown in the drawings). The waveform ROM stores data of digital musical tones with different timbres corresponding to striking surface positions of the electronic hi-hat 80. In an example embodiment, the waveform ROM of the sound source 16 stores data for four kinds of hi-hat sounds (open sound, half-open sound, slightly-open sound, and closed sound). Also, a DSP (digital signal processor) is built into the sound source 16, to perform various processing, such as, but not limited to filter, effect, and the like. The DSP may form a function of a TVF (time variant filter). In one example, the TVF is a low-pass filter with which the cut-off frequency can be changed. For example, when an open sound is generated by the sound source 16, the cut-off frequency is set to a relatively high value. On the other hand, when a closed sound is generated, the cut-off frequency is set to a lower value.

When a tone generation instruction is inputted from the CPU 11, the sound source 16 reads, from the waveform ROM, data for a digital musical tone with a timbre that corresponds to the tone generation instruction. Further, the sound source 16 performs predetermined processing, such as, but not limited to filter, effect, and the like, and outputs to the DAC 17, a digital musical tone signal that has been processed. The DAC 17 converts the inputted digital musical tone signal into an analog musical tone signal, and outputs the same to the amplifier 41 that may be provided outside the musical tone control device 1. The amplifier 41 amplifies the inputted analog musical tone signal and drives the speaker 42.

Examples of tone generation (generation of musical tones) control and tone silencing (stopping musical tones being generated) control performed by the musical tone control device 1 are described with reference to FIG. 3.

A striking surface position of the electronic hi-hat 80 is specified according to a displacement sensor value. More specifically, as shown in FIG. 3, the output range of the displacement sensor value is divided into four ranges, which are specified as an open position, a half-open position, a slightly-open position, and a closed position, in descending order from a larger displacement sensor value. Among the four kinds of striking surface positions, the open position, the half-open position and the slightly-open position are striking surface positions of the open group, where the upper cymbal 100 and the lower cymbal 200 are not in contact with each other. On the other hand, the closed position is a striking surface position where the upper cymbal 100 and the lower cymbal 200 are in contact with each other. When the upper cymbal 100 is struck, the musical tone control device 1 generates a hi-hat sound with a timbre (open sound, half-open sound, slightly-open sound, or closed sound) which corresponds to the striking surface position indicated by the displacement sensor value at that moment.

A stop control position P1 is specified in the range of the slightly-open position. When the striking surface position reaches the specified stop control position P1 included in the slightly-open position, the musical tone control device 1 stops the open sound and the half-open sound, and stops the slightly-open sound that satisfies a specified condition.

An open position P2 is specified at a predetermined position higher than the stop control position P1. According to the present embodiment, the open position P2 is specified within the range of the half-open position. The open position P2 is the position that is referred to for performing the silencing control of the slightly-open sound. The musical tone control device 1 in accordance with the present embodiment is configured such that, after the slightly-open sound was started and the striking surface position then reached the specified open position P2, the slightly-open sound being generated is stopped when the striking surface position reaches the stop control position P1. By the musical tone control device 1 thus configured, the hi-hat performance technique in which the pad is struck at the slightly-open position, followed by the striking surface position then momentarily being opened by releasing the foot pedal, and thereafter the foot pedal is stepped on again to return the striking surface position to the closed position, can be realized according to the performer's intention.

Figure 4:
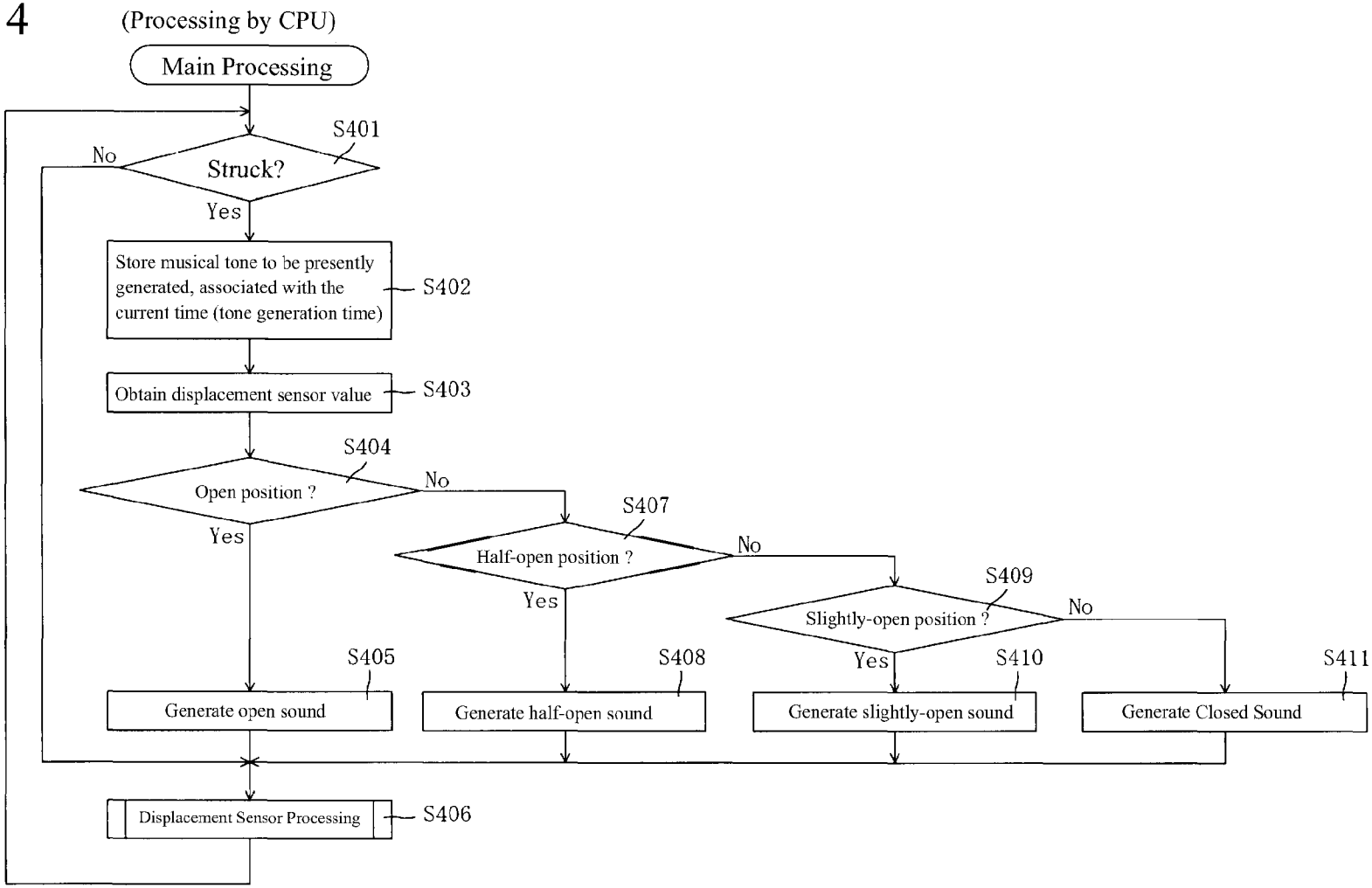
FIG. 4 is a flow chart showing processing executed by the CPU in the electrical configuration of FIG. 2, according to an embodiment of the present invention.
Figure 5:
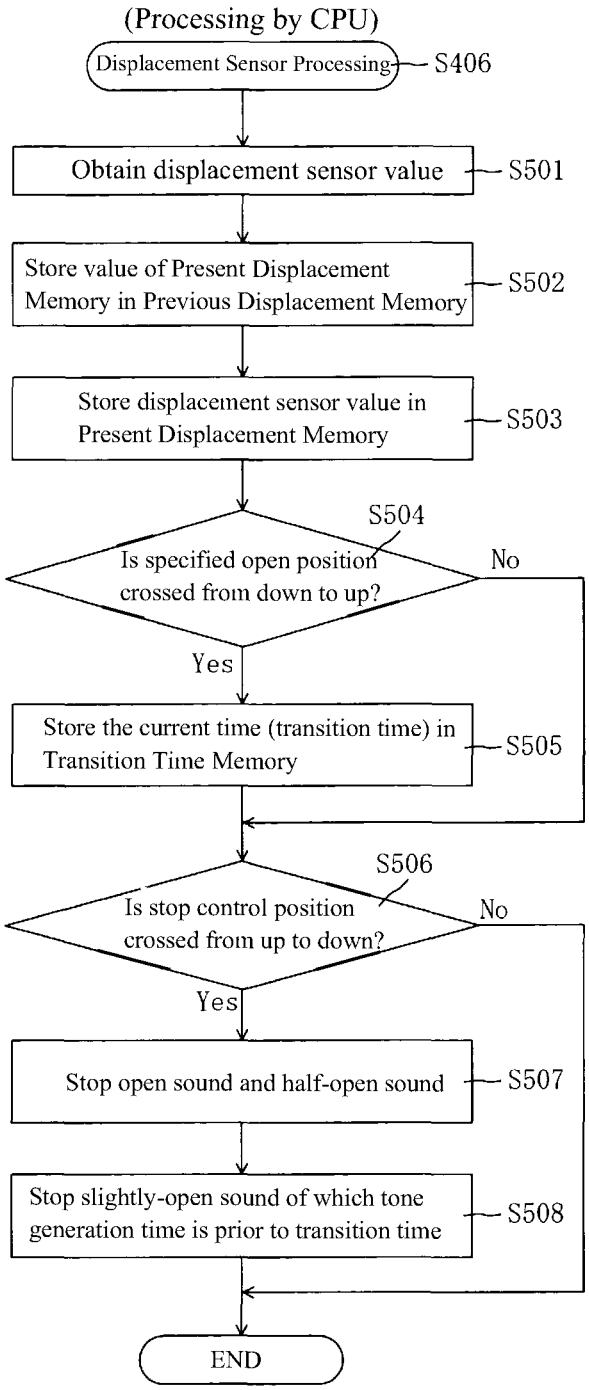
FIG. 5 is a flow chart showing displacement sensor processing executed in the processing of FIG. 4.

Processing executed by the CPU 11 of the musical tone control device 1 is described with reference to FIG. 4 and FIG. 5. Main processing shown in FIG. 4 is repeatedly executed while the musical tone control device 1 is powered on.

First, the CPU 11 determines, based on strike information inputted from the vibration sensor 70, whether or not the upper cymbal 100 of the electronic hi-hat 80 has been struck (S401). Specifically, in S401, the CPU 11 determines that the upper cymbal 100 has been struck, when the vibration level indicated by the vibration information exceeds a predetermined threshold value.

When the CPU 11 determines in S401 that the upper cymbal 100 has been struck (S401: Yes), the CPU 11 stores a musical tone to be presently generated (a musical tone that corresponds to the present tone generation instruction), and the current time obtained from the timer 11*a* as a tone generation time associated with the musical tone (S402). In accordance with the present embodiment, in S402, the CPU 11 stores the tone generation time (the current time) in a tone generation time region of the presently generating tone memory 13*a*, for the musical tone to be presently generated.

Next, the CPU 11 obtains a displacement sensor value inputted from the displacement sensor 60 (S403). In addition, the CPU 11 stores timbre information based on the obtained displacement sensor value, in a timbre storage region that corresponds to the generation time region that stored the tone generation time in S402. Further, the CPU 11 stores voice information indicative of the assigned voice in the voice storage region that corresponds to the tone generation time region.

After the processing in S403, when the CPU 11 determines that the obtained displacement sensor value indicates an open position (S404: Yes), the CPU 11 outputs an instruction to generate an open sound to the sound source 16. In other words, the CPU 11 instructs the sound source 16 to generate an open sound (S405).

On the other hand, when the CPU 11 determines that the obtained displacement sensor value indicates a half-open position (S404: No, S407: Yes), the CPU 11 outputs an instruction to generate a half open sound to the sound source 16. In other words, the CPU 11 instructs the sound source 16 to generate a half open sound (S408).

Also, when the CPU 11 determines that the obtained displacement sensor value indicates a slightly-open position (S404: No, S407: No, S409: Yes), the CPU 11 outputs an instruction to generate a slightly-open sound to the sound source 16. In other words, the CPU 11 instructs the sound source 16 to generate a slightly-open sound (S410).

Further, when the CPU 11 determines that the obtained displacement sensor value does not indicate an open position, a half open position or a slightly-open position, in other words, indicates a closed position (S404: No, S407: No, S409: No), the CPU 11 outputs an instruction to generate a closed sound to the sound source 16. In other words, the CPU 11 instructs the sound source 16 to generate a closed sound (S411).

After executing the processing in S405, S408, S410 or S411, the CPU 11 executes displacement sensor processing (S406), and completes the current processing. The displacement sensor processing (S406) performs the control to stop the musical sound being generated (during tone generation) according to the displacement sensor value inputted from the displacement sensor 60.

The displacement sensor processing (S406) is described with reference to FIG. 5. According to the displacement sensor processing (S406), the CPU 11 first obtains a displacement sensor value provided from the displacement sensor 60 (S501).

Next, the CPU 11 moves the value stored in the present displacement memory 13*b* to the previous displacement memory 13*c* (S502). By the processing in S502, a displacement sensor value obtained in the displacement sensor processing previously executed is stored in the previous displacement memory 13*c* as the previous value. In addition, the CPU 11 stores the displacement sensor value obtained in S501 in the present displacement memory 13*b*, as a present value (S503).

After executing the processing in S503, the CPU 11 determines, based on the displacement sensor values stored in the present displacement memory 13*b* and the previous displacement memory 13*c*, whether or not the striking surface position has crossed the specified open position P2 from down to up (S504). If the CPU 11 determines that the striking surface position has crossed the specified open position P2 from down to up (S504: Yes), then the CPU 11 stores the current time obtained from the timer 11*a* as a transition time in the transition time memory 13*d* (S505), and shifts the processing to S506. On the other hand, if the CPU 11 determines that the striking surface position has not crossed the specified open position P2 from down to up (S504: No), then the CPU 11 shifts the processing to S506.

In S506, the CPU 11 determines, based on the displacement sensor values stored in the present displacement memory 13*b* and the previous displacement memory 13*c*, whether or not the striking surface position has crossed the stop control position P1 from up to down (S506). In this instance, if the CPU 11 determines that the striking surface position has crossed the stop control position P1 from up to down (S506: Yes), the CPU 11 outputs an instruction to stop an open sound and a half open sound. In other words, the CPU 11 instructs the sound source 16 to stop generation of the open sound and the half open sound (S507). In S507, if the presently generated tone memory 13*a* does not store an open sound or a half open sound being generated from the sound source 16, the processing in S507 may be omitted.

Next, based on the content of the presently generated tone memory 13*a*, the CPU 11 outputs, to the sound source 16, an instruction to stop a slightly-open sound with the tone generation time that is prior to the transition time stored in the transition time memory 13*d*. In other words, the CPU 11 instructs the sound source 16 to stop generation of the corresponding slightly-open sound (S508), and completes the present processing.

Accordingly, even when the striking surface position has reached the stop control position P1, only a slightly-open sound with the tone generation time that is prior to the transition time stored in the transition time memory 13*d* is stopped. In other words, the slightly-open sound that is to be stopped is limited to the slightly-open sound that was started before the striking surface position reached the specified open position P2. More specifically, the slightly-open sound that is to be stopped when the striking surface position reaches the stop control position P1 is limited to the slightly-open sound corresponding to the striking surface position that has been momentarily elevated to reach the specified open position P2, after the sound generation was started.

In this manner, by referring to the tone generation time of the slightly-open sound and the time (the transition time) at which the striking surface position crossed the specified open position P2 from down to up, the transition state (displacement state) of the striking surface position after generation of the slightly-open sound started can be assumed. Such a transition state of the striking surface reflects the hi-hat performance technique of striking the pad at the slightly-open position, momentarily opening the striking surface position, and thereafter returning the striking surface position to the closed position. Therefore, the slightly-open sound that is to be stopped when the striking surface position reaches the stop control position P1 is limited to a slightly-open sound of which the striking surface position has temporarily elevated since the tone generation was started, and reached the specified open position P2. In the performance technique described above, a slightly-open sound that is to be stopped can be prevented from being continuously generated. Therefore, the performance technique described above can be carried out according to the performer's intention. Furthermore, because a slightly-open sound is not stopped (except upon the above-described situation), even when the striking surface position reaches the stop control position P1, slight movements of the foot pedal do not cause an unnatural stop, when the stop control position P1 is set at the slightly-open position, of the slightly-open sound that is generated by a strike while the hi-hat is at the slightly-open position.

The invention has been described above based on example embodiments. However, the invention need not be limited in any particular manner to the embodiments described above, and various improvements and changes can be made without departing from the subject matter of the invention.

For example, in the embodiment described above, the musical tone control device 1 controls musical tones of the electronic hi-hat 80. However, in further embodiments of the invention, a musical tone control device may also be connected to control musical sounds of an electronic drum, an electronic cymbal, and the like that compose an electronic drum set that includes the electronic hi-hat 80.

Also, in the embodiment described above, the musical tone control device 1 is configured with the sound source 16 and the DAC 17 built therein. However, the musical tone control device 1 can be configured without the sound source 16 and the DAC 17, and may be configured such that tone generation instructions and tone stop instructions based on the flow charts in FIGS. 4 and 5 are outputted to an independent, external sound source. Alternatively or in addition, the musical tone control device 1 may be built into the electronic hi-hat 80.

Further, in embodiments described above, the musical tone control device 1 is configured to assume the transition state of the striking surface position after generation of a slightly-open sound is started (when the upper cymbal 100 is struck at the slightly-open position), based on the relation between the tone generation time of the slightly-open sound and the time (transition time) at which the striking surface position crossed the specified open position P2 from down to up. However, in other embodiments, the method of presuming the transition state of the striking surface position when generation of the slightly-open sound was started is carried out in other suitable manners.

For example, in such other embodiments, a counter that is periodically updated may be provided. Thus, when a slightly-open sound is generated, instead of the current time, a counter value may be associated with slightly-open sound information and stored in the presently generated sound memory 13*a*. In such embodiments, when the striking surface position reaches the stop control position P1, a counter value at this moment may be compared with a counter value stored in the presently generated sound memory 13*a*. A stop instruction may be outputted to the sound source 16 for a slightly-open sound corresponding to a counter value smaller than the counter value given when the striking surface position reached the stop control position P1.

In accordance with another example, a flag may be associated with a slightly-open sound among musical sounds stored in the presently generated sound memory 13*a*. When the striking surface position reaches the stop control position P1, the slightly-open sound to be instructed to stop may be determined according to the state of the flag. In other words, in S408 of the processing (FIG. 4), a flag associated with the slightly-opened sound currently generated is initialized (set to OFF), and in S504 of the displacement sensor processing (FIG. 5), when it is determined that the striking surface position crossed the specified open position P2 from down to up, the flag associated with the slightly-open sound being currently generated is set to ON. Then, in S506, when it is determined that the striking surface position crossed the stop control position P1 from up to down, a stop instruction for the slightly-open sound with the flag set to ON may be outputted to the sound source 16.

Further, a counter may be provided and associated with a slightly-open sound among musical sounds stored in the presently generated sound memory 13*a*, and the counter associated with the slightly-open sound may be updated each time the striking surface position (in other words, the displacement sensor value) changes by a predetermined amount. When the striking surface position reaches the stop control position P1, a stop instruction corresponding to a slightly-open sound with a counter value exceeding a predetermined threshold value, among the musical sounds stored in the presently generated sound memory 13*a*, may be outputted to the sound source 16. In other words, a slightly-open sound of which the striking surface position, after generation of the sound was started, has a large amount of change (large amount of displacement) may be assumed to be a slightly-open sound of which the striking surface position has temporarily elevated after generation of the sound was started, and reached the specified open position P2, and generation of the corresponding slightly-open sound may be stopped.

Also, in embodiments described above, when the upper cymbal 100 is struck, its tone generation time is stored regardless of the types of the timbres. However, only when the sound to be generated is a slightly-open sound, the tone generation time to be used for measurement of the transition state of the striking surface position thereafter may be stored.

Also, embodiments described above are configured to determine, in S504, whether or not the specified open position P2 is crossed from down to up. However, further embodiments may be configured to determine whether or not the specified open position P2 is crossed from up to down. Alternatively, further embodiments may be configured to determine whether or not the striking surface position has reached the specified open position P2, regardless of the crossing direction. In other words, the time (transition time) stored in the transition time memory 13*d* in S505 may be used as the time when the striking surface position reached the specified open position P2 last time, regardless of the crossing direction.

Also, embodiments described above are configured to determine in S506 whether or not the stop control position P1 is crossed from up to down. However, further embodiments may be configured to determine whether or not the striking surface position has reached the stop control position P1, regardless of the crossing direction. When determining whether or not the striking surface position has reached the stop control position P1 or the specified open position P2 regardless of the crossing direction, at least the previous displacement memory 13*c* may be unnecessary and, thus, may be omitted.

Also, in embodiments described above, the specified open position P2 is within the range of the half-open position. However, in other embodiments, the specified open position P2 may be any position higher than the stop control position P1. In other words, the specified open position P2 may be set in the range of the open position or the slightly-open position, which are higher than the stop control position P1. However, in certain embodiments, it is preferable to set the specified open position P2 higher than the stop control position P1 so that slight movements of the foot pedal do not cause an unnatural stop of a slightly open sound that is generated by a strike while the hi-hat is at the slightly-open position. Also, the specified open position P2 may be configured to be suitably changed by the user.

In embodiments described above, an example of the electronic hi-hat 80 includes the upper cymbal 100 and the lower cymbal 200. However, other embodiments of the invention are applicable to other example configurations of electronic hi-hats, including electronic hi-hats without a lower cymbal, such as, but not limited to, the electronic percussion musical instrument described in Japanese Laid-open Patent Application 2006-201334, which is incorporated herein by reference in its entirety.

Embodiments described above are configured such that the striking surface position is detected based on an output (a displacement sensor value) of the displacement sensor 60 provided between the upper cymbal 100 and the lower cymbal 200. However, in further embodiments, the striking surface position is detected based on an output of a sensor that detects the amount that the pedal section is stepped on, such as, but not limited to, the configuration described in, for example, Japanese Laid-open Patent Application HEI09-097075, which is incorporated herein by reference in its entirety.

Embodiments described above employ examples of the position information acquisition device operations S403 and S501, examples of the strike information acquisition device operation S401, examples of the tone generation instruction device operations S405, S408, S410 and S411, examples of the tone stop instruction device operations S507 and S508, examples of the transition state information acquisition device operations S402 and S505, examples of the first time information acquisition device operation S402, and examples of the second time information acquisition device operation S505. However, other embodiments may employ other suitable operations of those devices.

The invention claimed is:

1. A musical tone control device for an electronic percussion musical instrument that has a striking surface with a moveable striking surface position, the musical tone control device comprising:

a position information acquisition device that obtains striking surface position information corresponding to the striking surface position;

a strike information acquisition device that obtains strike information indicating that the striking surface has been struck;

a musical tone generation instruction device that, when strike information is obtained by the strike information acquisition device, provides instructions for a sound source to generate a musical tone with a timbre corresponding to the striking surface position information obtained by the position information acquisition device, the musical tone generation instruction device providing instructions for the sound source to generate a musical tone with a first timbre when the striking surface position information corresponds to the striking surface position being within a predetermined range, where the predetermined range includes at least a first position;

a musical tone stop instruction device that provides instructions for the sound source to stop a musical tone being generated, when the striking surface position information obtained by the position information acquisition device corresponds to the striking surface position being the first position; and a transition state information acquisition device that obtains information relating to a transition state of the striking surface position, based on the position information obtained by the position information acquisition device, after the musical tone generation instruction device provides instructions to generate a musical tone with the first timbre;

wherein, when the striking surface position information obtained by the position information acquisition device corresponds to the first position, the sound source stop instruction device provides instructions for the sound source to stop generating a musical tone with the first timbre, in response to information obtained by the transition state information acquisition device that corresponds to the striking surface position reaching a predetermined second position higher than the first position after the musical tone generation instruction device provided instructions for generating the musical tone.

2. A musical tone control device according to claim 1, wherein the transition state information acquisition device includes:

a first time information acquisition device that obtains, when the musical tone generation instruction device provides instructions for the sound source to generate a musical tone with the first timbre, first time information associated with the musical tone to be generated, and a second time information acquisition device that obtains, when the striking surface position information obtained by the position information acquisition device corresponds to the second position, second time information associated with the musical tone to be generated;

wherein the musical tone stop instruction device provides instructions for the sound source to stop generating a musical tone with the first timbre when the striking surface position information obtained by the position information acquisition device corresponds to the first position, the musical tone with the first timbre corresponding to the first time information that is earlier than the second time information.

3. A musical tone control device according to claim 1, wherein the transition state information acquisition device includes an information storage device that stores, when the musical tone generation instruction device provides instructions for the sound source to generate a musical tone with the first timbre, first information associated with the musical tone to be generated, and an information change device that changes, when the striking surface position information obtained by the position information acquisition device corresponds to the second position, the first information stored in the information storage device to second information associated with the musical tone to be generated;

wherein the musical tone stop instruction device provides instructions for the sound source to stop generating a musical tone with the first timbre, when the striking surface position information obtained by the position information acquisition device corresponds to the first position, the musical tone with the first timbre being associated with the second information stored in the information storage device.

4. A musical tone control device according to claim 1, wherein the transition state information acquisition device includes a shift amount information acquisition device that obtains, when the musical tone generation instruction device provides instructions for the sound source to generate a musical tone with the first timbre, shift amount information corresponding to a shift amount that the striking surface position shifted while the musical tone is being generated from the sound source, based on striking surface position information obtained by the position information acquisition device, and the musical tone stop instruction device provides instructions for the sound source to stop generating a musical tone with the first timbre when the striking surface position information obtained by the position information acquisition device corresponds to the first position, the musical tone with the first timbre having the shift amount corresponding to the shift amount information obtained by the shift amount information acquisition device that exceeds a predetermined threshold value.

5. A musical tone control device for an electronic percussion musical instrument having a striking surface with a moveable striking surface position, the musical tone control device comprising a processing device configured to:

provide instructions to generate a musical tone with a timbre corresponding to the striking surface position, when the striking surface has been struck;

provide instructions for generating a musical tone with a first timbre, when the striking surface has been struck and the striking surface position is within a predetermined range, wherein the predetermined range includes at least a predetermined first position; and provide instructions to stop generating the musical tone with the first timbre after providing instructions for generating the musical tone with the first timbre, when the striking surface position reaches or crosses a predetermined second position and then reaches or crosses the predetermined first position.

6. A musical tone control device according to claim 5, further comprising:

a position information acquisition device that obtains striking surface position information corresponding to the striking surface position; and a strike information acquisition device that obtains strike information when the striking surface has been struck;

wherein the processing device is connected to determine the striking surface position based on the striking surface position information, and to determine that the striking surface has been struck based on the strike information.

7. A musical tone control device according to claim 5, wherein the predetermined first position is within the predetermined range.

8. A musical tone control device according to claim 5, wherein the processing device is further configured to:

obtain first time information associated with the musical tone to be generated, the first time information corresponding to a time when the processing device provides instructions to generate a musical tone with the first timbre;

obtain second time information associated with the musical tone to be generated, the second time information corresponding to a time when the striking surface position reaches or crosses the predetermined second position; and provide instructions to stop generating a musical tone with the first timbre when the striking surface reaches or crosses the first position, wherein the musical tone with the first timbre corresponds to the first time information and wherein the time corresponding to the first time information is earlier than the time corresponding to the second time information.

9. A musical tone control device according to claim 5, further comprising:

an information storage device that stores first information associated with the musical tone to be generated, when the processing device provides instructions to generate a musical tone with the first timbre; and wherein the processing device is further configured to change the first information stored in the information storage device to second information associated with the musical tone to be generated, when the striking surface position reaches or crosses the predetermined second position;

wherein the processing device is further configured to provide instructions to stop generating a musical tone with the first timbre, when the striking surface position reaches or crosses the predetermined first position, the musical tone with the first timbre being associated with the second information stored in the information storage device.

10. A musical tone control device according to claim 5, wherein:

when the processing device provides instructions to generate the musical tone with the first timbre, the processing device obtains shift amount information corresponding to a shift amount that the striking surface position shifted while the musical tone is being generated; and the processing device is further configured to provide instructions to stop generating the musical tone with the first timbre, when the striking surface position corresponds to the first position and the shift amount exceeds a predetermined threshold value.

11. A method of controlling musical tone for an electronic percussion musical instrument having a striking surface with a moveable striking surface position, the method comprising:

providing instructions to generate a musical tone with a timbre corresponding to the striking surface position, when the striking surface has been struck;

providing instructions for generating a musical tone with a first timbre, when the striking surface has been struck and the striking surface position is within a predetermined range, wherein the predetermined range includes at least a predetermined first position; and providing instructions to stop generating the musical tone with the first timbre after providing instructions for generating the musical tone with the first timbre, when the striking surface position reaches or crosses a predetermined second position and then reaches or crosses the predetermined first position.

12. A method according to claim 11, further comprising:

connecting a position information acquisition device to the electronic percussion musical instrument, to obtain striking surface position information corresponding to the striking surface position; and connecting a strike information acquisition device to the electronic percussion musical instrument to obtain strike information when the striking surface has been struck;

determining the striking surface position based on the striking surface position information; and determining that the striking surface has been struck based on the strike information.

13. A method according to claim 11, wherein the predetermined first position is within the predetermined range.

14. A method according to claim 11, further comprising:

obtaining first time information associated with the musical tone to be generated, the first time information corresponding to a time when instructions are provided to generate a musical tone with the first timbre, and obtaining second time information associated with the musical tone to be generated, the second time information corresponding to a time when the striking surface position reaches or crosses the predetermined second position; and providing instructions to stop generating a musical tone with the first timbre when the striking surface reaches or crosses the first position, wherein the musical tone with the first timbre corresponds to the first time information and wherein the time corresponding to the first time information is earlier than the time corresponding to the second time information.

15. A method according to claim 11, further comprising:

storing, in an information storage device, first information associated with the musical tone to be generated, when instructions are provided to generate a musical tone with the first timbre;

changing the first information stored in the information storage device to second information associated with the musical tone to be generated, when the striking surface position reaches or crosses the predetermined second position; and providing instructions to stop generating a musical tone with the first timbre, when the striking surface position reaches or crosses the predetermined first position, the musical tone with the first timbre being associated with the second information stored in the information storage device.

16. A method according to claim 11, further comprising:

obtaining shift amount information when instructions are provided to generate the musical tone with the first timbre, the shift amount information corresponding to a shift amount that the striking surface position shifted while the musical tone is being generated; and providing instructions to stop generating the musical tone with the first timbre, when the striking surface position corresponds to the first position and the shift amount exceeds a predetermined threshold value.

* * * * *